United States Patent [19]

Hersey

[11] Patent Number: 4,577,787

[45] Date of Patent: Mar. 25, 1986

[54] INVERTIBLE AND REVERSIBLE HOLSTER

[76] Inventor: Fredrick B. Hersey, 360 Fairview Dr., Carson City, Nev. 89701

[21] Appl. No.: 608,706

[22] Filed: May 10, 1984

[51] Int. Cl.[4] ..... F41C 33/02

[52] U.S. Cl. ..... 224/243; 224/192; 224/911

[58] Field of Search ..... 224/911, 912, 243, 192, 224/193

[56] References Cited

U.S. PATENT DOCUMENTS

| | | | |
|---|---|---|---|
| 309,292 | 12/1884 | Browne | 224/911 X |
| 2,434,380 | 1/1948 | Williams | 224/911 X |
| 3,003,670 | 10/1961 | Stella | 224/911 X |
| 3,583,611 | 6/1971 | Theodore | 224/911 X |
| 3,583,612 | 6/1971 | Theodore | 224/911 X |
| 3,731,858 | 5/1973 | Baker | 224/192 |
| 3,847,315 | 11/1974 | Bianchi | 224/912 X |
| 4,044,930 | 8/1977 | Petroski | 224/912 X |
| 4,253,592 | 3/1981 | Anderson | 224/911 X |

*Primary Examiner*—Stephen Marcus
*Assistant Examiner*—Robert Petrik

[57] ABSTRACT

A holster made of two matching pieces of material joined together to form a double-ended gun pocket, shaped to fit a particular gun and contain substantial portions of it. The holster has a belt loop on each face of the gun pocket and a belt slot through both faces outside of the trigger guard area, which position the gun and holster on a belt at an acute angle from the vertical, such that a forward-tilt and a cross-draw slant mode of carry are both made possible by inverting the holster and thus reversing the angle. Reversing the holster laterally changes it from right-handed to left-handed.

5 Claims, 3 Drawing Figures

INVERTIBLE AND REVERSIBLE HOLSTER

This invention relates generally to article carriers and specifically to an improved handgun holster.

Belt-slide holsters are generally abbreviated, compact and light-weight. They combine comfort and concealability, qualities needed in law enforcement and security work. My desire for such a holster that would angle the gun for a cross-draw was met with many examples of a strong-side, forward tilt or FBI tilt, where the strong hand draws the gun from the same side of the torso. See FIG. 2. Many, like myself, prefer a cross-draw, where the strong hand reaches across the torso to draw the gun. My invention is the result of my efforts to solve this problem.

PRIOR ART

The Baker holster (U.S. Pat. No. 3,731,858), while it can in some forms be used right and left-handed as well as strong side or cross-draw, does not qualify as abbreviated, compact and light-weight. For cross-draw, it holds the gun in an upright position, rather than slanted toward the hand that must reach across the torso. Nor does it accomplish any of these things through the use of a double-ended gun pocket, as my invention does. Another holster that I have seen, the Tabler Marketing holster, is also able to accommodate right- or left-hand use, as well as strong side and cross-draw. While in some ways it may qualify as abbreviated, it is not as compact and light-weight as my invention, and again it does not use a double-ended gun pocket. It uses an adjustable gun pocket, and when its two separate parts are appropriately readjusted, the gun may then be inserted from the other direction, into a newly created gun pocket. While my invention will not accommodate a variety of guns, like the Tabler Marketing, being sized for the specific gun to be carried, neither does it have to be any larger than necessary for that gun. In order to accommodate "any gun", the Tabler holster does have to be bulky enough to hold the largest. Another holster I have seen has an essentially symmetrical gun pocket so that the gun butt can be turned either way, thus being somewhat right- or left-handed. However, it can only hold the gun in a forward tilt position.

OBJECTS

Accordingly, several objects of my invention are a holster that:

a. reverses the angle of carry of the gun from an appropriate cross-draw slant to the popular FBI tilt, by inverting the holster.

b. changes completely from right-handed to left-handed by reversing the holster.

c. is abbreviated, compact, light-weight.

d. is comfortable and convenient to wear.

e. keeps the gun butt in close proximity to the torso for minimum protrusion and optimum concealability.

f. provides good retention of the gun while carrying.

g. allows for quick withdrawal of the gun when needed.

h. is simple and economical to manufacture.

i. has eye and sales appeal.

j. is sized to fit the gun to be carried.

k. can be worn on a belt with the gun pocket either inside or outside of the belt.

Further objects and advantages of my invention will become apparent from consideration of the drawings and ensuing description thereof.

DRAWINGS

DESCRIPTION

Figure 1:
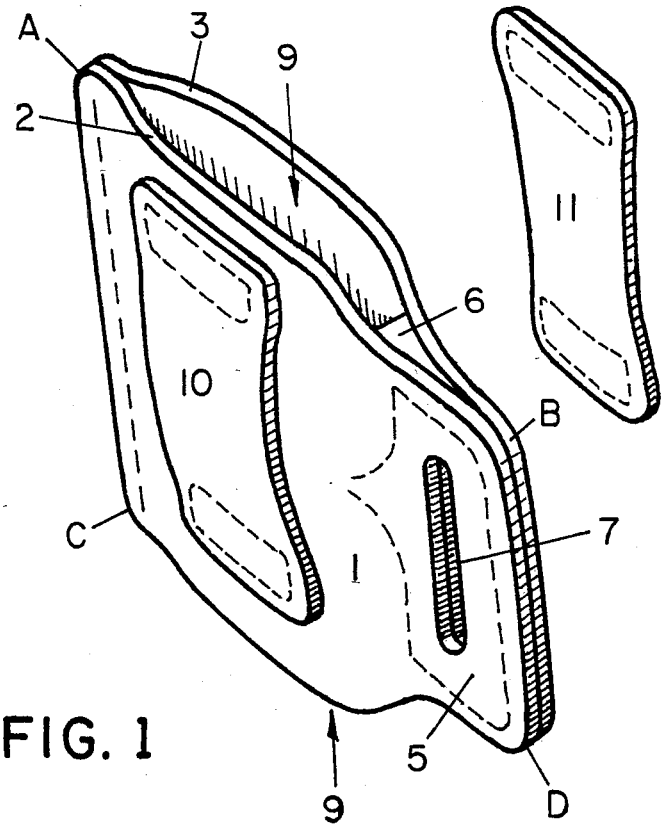
FIG. 1 is a view showing the essential construction of a preferred embodiment of the present invention.

Reference is now made to the drawings which illustrate the best presently known embodiment of my invention. The holster 1 is formed of a pair of identically shaped pieces of leather, faces 2 and 3, which are joined together in an overlying relationship, forming the outer faces of the gun pocket, which is fitted to the specific gun and capable of receiving the muzzle of the gun from either end, and enclosing and retaining substantial portions of the barrel, slide, receiver and trigger guard. The joining is accomplished by stitching faces 2 and 3 together at the edge A–C adjacent to the top of the gun 4, and also stitching together the belt slot tab 5 extension of the faces, with the trigger guard welt 6 (shown by dotted lines) being stitched between them in the area from the slot 7 to the trigger guard stop 8 of the gun 4. Stitching is shown by dashed lines. Leather in the 8–9 ounce range is preferred because it is flexible enough to allow insertion and withdrawal of a handgun and stiff enough to retain said handgun until intentionally withdrawn. The gun pocket 9 is formed by the outward bowing of faces 2 and 3 as shown in FIG. 1. The belt loops 10 and 11, are another pair of identically shaped pieces of leather, and are joined at their top and bottom edges to the outside of faces 2 and 3, by stitching.

OPERATION

Figure 2:
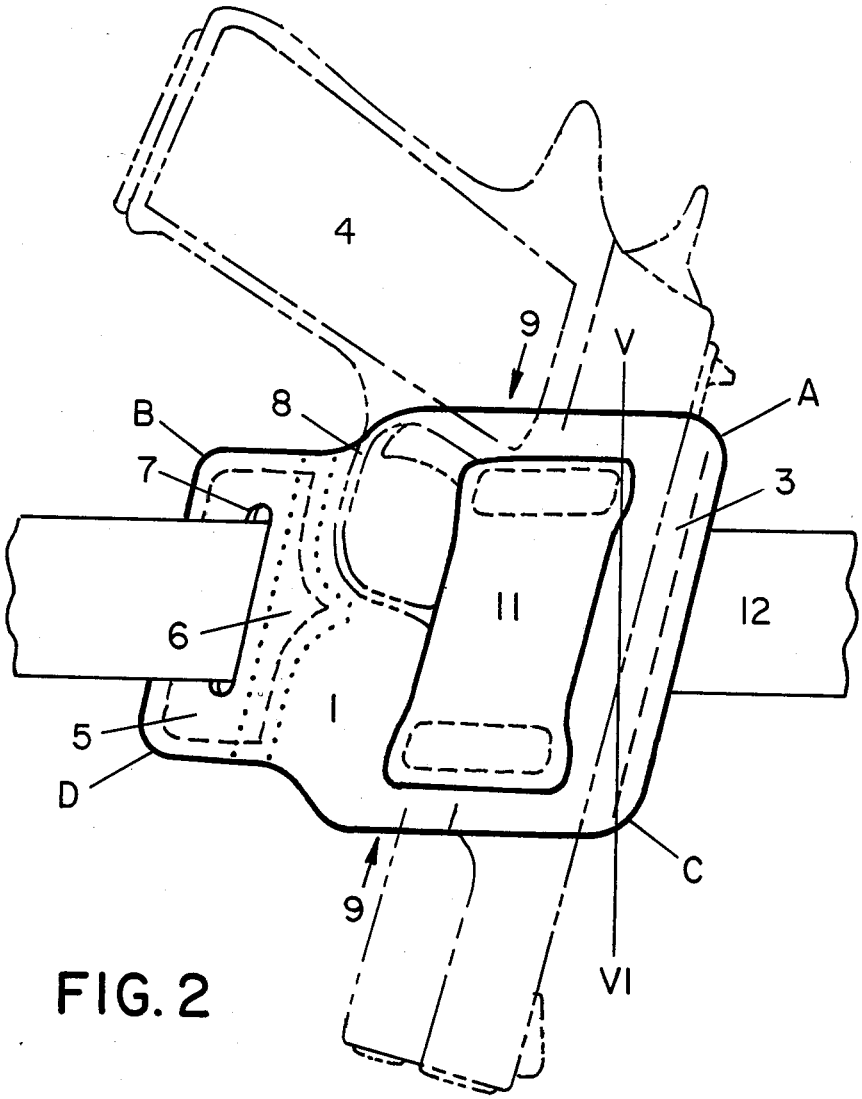
FIG. 2 is an elevation view of the present invention in its position for right-handed strong side draw.
Figure 3:
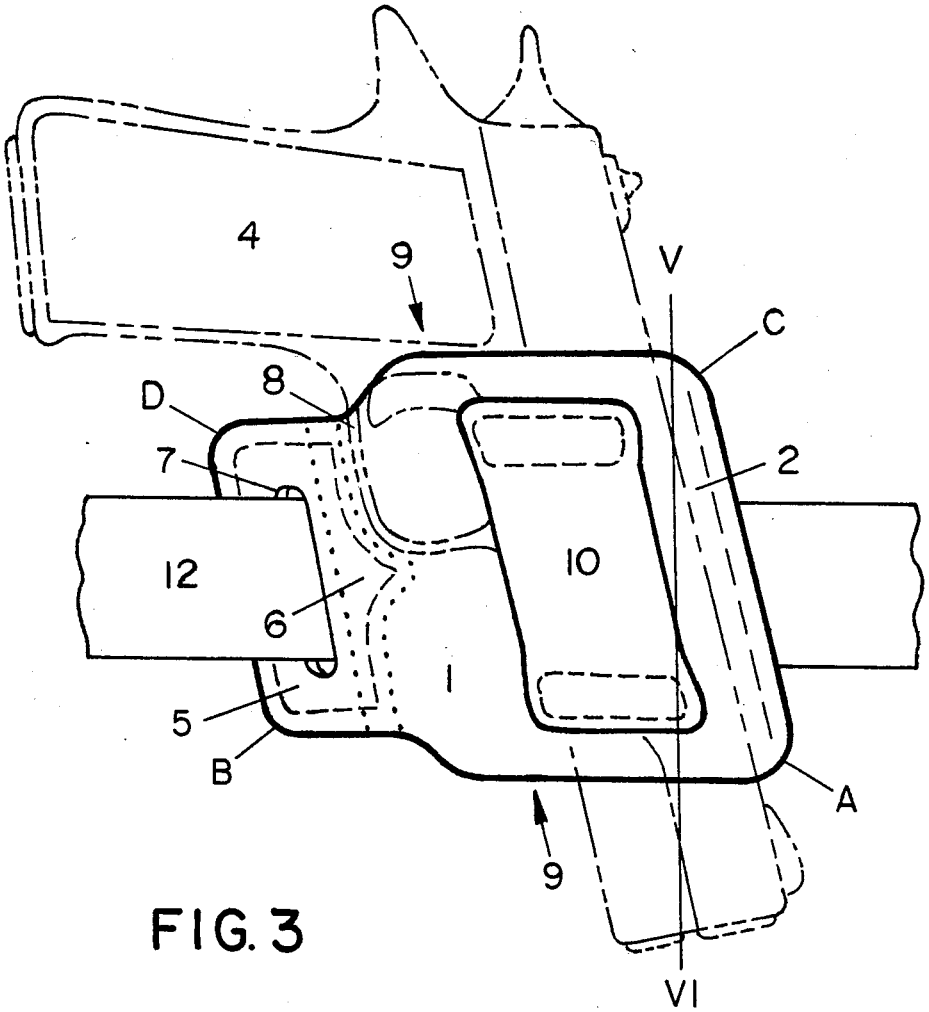
FIG. 3 is an elevation view of the present invention in its position for a right-handed cross-draw.

The gun pocket 9 is open at the top and bottom so that the holster 1 can be inverted to change it from a strong-side forward tilt mode to a cross-draw mode. The gun 4 is placed into the top opening of the gun pocket 9 in either mode. The placement of the belt slot 7 and the belt loops 10 and 11 are such that in the strong side forward tilt mode, FIG. 2, the top of the gun A–C forms an angle of 10 to 20 degrees from the vertical V–V1. By inverting holster 1, the top A–B becomes the bottom, and the bottom C–D now becomes the top. Replacing the gun 4 into the top opening of the gun pocket 9, the gun is now positioned in the cross-draw mode, FIG. 3. The angle between the top of the gun, A–C and vertical V–V1 is the same but in the opposite direction. The gun 4 is now angles toward the hand that must reach across the torso.

The symmetry of the holster is such that it is equally right- and left-handed. The belt 12 is passed through the belt slot 7 and through one of the belt loops, 10 or 11, depending on the anticipated mode of use.

For normal use the belt 12 will be passed through the belt loop between the gun pocket 9 and the wearer's body, but for better retention of the gun 4, the belt 12 may be passed through the belt loop on the side of the gun pocket 9 away from the body, adding the pressure of the belt to the outside of the gun pocket 9.

While the above description contains many specificities, these should not be construed as limitations on the scope of the invention, but rather as an exemplification of one preferred embodiment thereof. Many other variations are possible, for example the faces of the gun pocket could be made of one folded piece of leather, rather than two. The shape of the holster will vary to fit the gun to be carried. A retaining strap can be attached. The material can be any suitable material. Belt slots and belt loops can be used in various combinations.

I claim:

1. A belt holster made of sheet-like material having sufficient flexibility to allow insertion and withdrawal of a handgun from either end and sufficient stiffness to retain said handgun until intentionally withdrawn, comprising in combination:

a. a handgun carrier with its outer faces joined together such that the joining forms the shape of a double-ended gun pocket, and said joining forms a trigger guard stop, against which the trigger guard seats when the gun is inserted from either end, and with said gun pocket being fitted to the gun to be carried, and capable of enclosing major portions of the barrel, slide, receiver and trigger guard, and b. means for positioning said gun pocket on a belt in different directions and angles at any point on said belt.

2. A holster as set forth in claim 1 wherein said double-ended gun pocket comprises two matching pieces of material joined together interior their lateral edges.

3. A holster as set forth in claim 1 wherein said double-ended gun pocket comprises a symmetrical piece of material, folded at its axis of symmetry whereby its halves are in overlying relationship, and joined together interior the edges opposite the fold wherein said joining, in combination with said fold, defines the shape of said double-ended gun pocket.

4. A holster as set forth in claim 1 wherein said means for positioning said gun pocket comprises in combination, two additional smaller matching pieces of material joined at their top and bottom edges to each of the faces of the gun pocket so as to form belt receiving loops, and a belt receiving slot through both faces of the gun pocket just outside of the trigger guard area, said belt receiving slot being also the means for keeping the gun butt in close to the torso for better concealability.

5. A holster as set forth in claim 1 wherein additional pieces of material are joined between the faces of said gun pocket as additional means of shaping the inside of said gun pocket.

* * * * *